US006328644B1

(12) United States Patent
Kuramochi et al.

(10) Patent No.: US 6,328,644 B1
(45) Date of Patent: Dec. 11, 2001

(54) MOLDED ABRASIVE PRODUCT AND POLISHING WHEEL USING IT

(75) Inventors: Hideto Kuramochi; Shuji Takato; Yoshitaka Kubota, all of Kanagawa-ken (JP)

(73) Assignee: Tosoh Corporation, Shinnanyo (JP)

( * ) Notice: Subject to any disclaimer, the term of this patent is extended or adjusted under 35 U.S.C. 154(b) by 0 days.

(21) Appl. No.: 09/545,330

(22) Filed: Apr. 7, 2000

(30) Foreign Application Priority Data

Apr. 9, 1999 (JP) ..... 11-102362

(51) Int. Cl.[7] ..... B24D 11/00
(52) U.S. Cl. ..... 451/526; 451/539
(58) Field of Search ..... 51/298, 295, 293; 472/242; 451/28, 526, 539, 528

(56) References Cited

U.S. PATENT DOCUMENTS 5,611,827 * 3/1997 Hammarstrom et al. ..... 51/298
5,976,204 * 11/1999 Hammarstrom et al. ..... 51/298

FOREIGN PATENT DOCUMENTS 4-256581 9/1992 (JP) .
10-264015 10/1998 (JP) .
10-337669 12/1998 (JP) .

* cited by examiner

*Primary Examiner*—Derris H. Banks
(74) *Attorney, Agent, or Firm*—Oblon, Spivak, McClelland, Maier & Neustadt, P.C.

(57) ABSTRACT

A molded abrasive product which is made mainly of a zirconia component and which has a bulk density of from 0.5 to 5.2 g/cm$^3$, a BET specific surface area of from 0.1 to 100 m$^2$/g and an average particle size of from 0.005 to 50 $\mu$m.

4 Claims, No Drawings

MOLDED ABRASIVE PRODUCT AND POLISHING WHEEL USING IT

BACKGROUND OF THE INVENTION

1. Field of the Invention

The present invention relates to a molded abrasive product to be used in a mechanical polishing process or a chemical mechanical polishing (hereinafter referred to as CMP) process for polishing e.g. optical materials and substrate materials such as silicon wafers, oxide substrates, semiconductor substrates, glass substrates and ceramic substrates, and a polishing wheel using it.

2. Discussion of Background

Along with progress in e.g. optics and electronics industries, requirements for processing of e.g. magnetic disks, semiconductor substrates, single crystal materials and optical materials, have become very strict, and in the finishing of electronic parts, it has been required to make the surface of the material flat and smooth by polishing. Accordingly, a polishing treatment has heretofore been employed wherein the surface of the material is polished with a polishing pad (polishing cloth) made of e.g. nonwoven fabric or suede cloth, while a polishing liquid containing loose abrasive grains is continuously supplied thereon. As the loose abrasive grains, e.g. aluminum oxide, silicon oxide, cerium oxide, zirconium oxide, iron oxide, titanium oxide, manganese oxide or silicon carbide has been used.

However, by the polishing treatment using such loose abrasive grains, e.g. an edge of the material subjected to polishing (hereinafter referred to as material to be polished) may be polished too much during polishing since the surface of the polishing cloth used is soft, whereby the entire surface of the material to be polished can not be uniformly polished.

Further, with respect to the conventional polishing method using a polishing cloth, a polishing liquid containing no abrasive grains, such as water having its pH adjusted, can not be used in most cases, and accordingly, it is necessary to use a large amount of a polishing liquid containing loose abrasive grains. As a result, a waste polishing liquid containing a large amount of loose abrasive grains is produced, and its treatment has to be improved in view of efficiency of the polishing treatment, equiμments for the waste disposal and the influence over environment.

To overcome the above problem, e.g. JP-A-4-256581 proposes a polishing method of a fixed system using a composite grinding wheel having abrasive grains bound by a synthetic resin, for polishing. This method using the composite grinding wheel, is disclosed to be effective to overcome such a problem that the entire surface of the material to be polished can not be uniformly polished, which has occurred in the conventional polishing method using a polishing cloth.

However, with such a grinding wheel, the synthetic resin used as a binder is present also at its surface which takes part in polishing, whereby the same condition as so-called clogging tends to occur, thus decreasing the polishing efficiency and productivity. Further, since a synthetic resin is used as a binder, the material to be polished is likely to be contaminated by impurities from the composite grinding wheel during the polishing process, depending upon the polishing conditions.

Under the circumstances, the present inventors have found that, as disclosed in JP-A-10-264015 for example, a molded abrasive product containing, as the main component, silica which is abrasive grains, is applicable to the polishing process, and conducted studies to overcome the above object, and as a result, they have found the following.

1) Since the molded abrasive product has a large elastic coefficient as compared with a polishing cloth, a corner of e.g. the edge of the material to be polished will be rarely polished too much, and accordingly, the entire surface of the material to be polished will be uniformly polished.

2) The surface of the molded abrasive product, taking part in polishing, is rough due to the silica powder as the material, and many pores are present among the silica particles, whereby so-called clogging in the polishing process will be suppressed.

3) The molded abrasive product contains no resin component, whereby it has e.g. heat resistance, chemical resistance and water resistance during the polishing process, and accordingly, the polishing liquid may be used even at a high temperature in the vicinity of its boiling point, and the type of the polishing liquid may be optionally selected, so that the polishing process can be carried out under an optimum condition, thus increasing the polishing efficiency.

4) The molded abrasive product is made of silica which is used as abrasive grains, and the influence of impurities resulting from the molded abrasive product on the material to be polished during the polishing process can be suppressed.

5) The level of the finishing of polishing of the material to be polished can be polished is about the same as in the conventional method by using a polishing cloth, and the polishing rate is equal to or higher than that of the conventional method, and further, deterioration of polishing performance with time is small in the polishing process.

6) The surface of the molded abrasive product, taking part in polishing, is rough due to a silica powder as the material, and since said surface is directly in contact with the material to be polished, the molded abrasive product may be applied to a process for polishing e.g. substrate materials by using a polishing liquid containing no loose abrasive grains.

7) Even in a case where an abrasive containing loose abrasive grains, such as aluminum oxide, silicon oxide, cerium oxide, zirconium oxide, manganese oxide, titanium oxide, magnesium oxide, iron oxide, chrome oxide or silicon carbide, or a mixture thereof, is used, an adequately high polishing rate can be obtained with a low concentration of loose abrasive grains as compared with the conventional method of using a polishing cloth.

As mentioned above, the molded abrasive product as disclosed in JP-A-10-264015 by the present inventors, is very suitable for a CMP process and a mechanical polishing process for polishing e.g. optical materials and substrate materials such as silicon wafers, oxide substrates, semiconductor substrates, glass substrates and ceramic substrates. However, the higher the hardness of the material to be polished, the smaller the polishing rate tends to be, and accordingly, a molded abrasive product which increases the polishing rate of a particularly hard material having a Vickers hardness of at least 650 kg/mm$^2$, has been desired.

Further, JP-A-10-337669 discloses a grinding wheel obtained by firing inorganic abrasive grains. It describes materials constituting the grinding wheel, the particle size, the porosity and the coefficient of water absorption, and describes that an effect similar to that in the above JP-A-10-264015 can be obtained. However, the surface precision of the silicon wafer as an example of the material to be polished, is such that the centerline average roughness is a level of 3 nm, and further, no mention is made of the polishing rate.

On the contrary, the above JP-A-10-264015 presents a result of measuring the surface precision of a silicon wafer by means of a universal surface-shape measuring apparatus. Since the apparatus has reached the limit in measurement, the present inventors have carried out also a measurement by means of an atomic force microscope (AFM), for more accurate measurement. As a result, it was clarified that the centerline average roughness is from 0.6 to 1 nm, and an excellent surface precision may be obtained.

However, such examples are mainly for polishing silicon wafers, and a molded abrasive product which has a performance to polish the surface of a material to be polished at a high rate with a high accuracy, and which will be useful for hard materials, particularly for hard materials having a Vickers hardness of at least 650 kg/mm$^2$, has been desired. A molded abrasive product for polishing such a hard material, to industrially make the surface extremely smooth and flat, will be useful for polishing substrates for electric materials and substrates for optical materials.

SUMMARY OF THE INVENTION

The present invention has been made to overcome the above object, and it is an object of the present invention to provide a molded abrasive product which can be applied to a mechanical polishing process and a CMP process for polishing substrate materials such as semiconductor substrates, oxide substrates and glass substrates and optical materials which require precision processing, i.e. a molded abrasive product with which polishing can effectively be carried out by using only a polishing liquid containing no loose abrasive grains or containing a small amount of loose abrasive grains so that the problem of the waste liquid can be reduced, with which the material to be polished can be polished more efficiently with the same or higher level of polish finishing as that obtained by the conventional method by using a polishing cloth, which has durability in the polishing treatment so that polishing can be carried out efficiently, and with which polishing can be carried out efficiently even on hard materials to be polished having a Vickers hardness of at least 650 kg/mm$^2$; and a polishing wheel using it.

The present inventors have conducted extensive studies to overcome the above object, and as a result, they have found that, in order to obtain the polished surface having a level equal to or higher than that obtained by the conventional method at a higher polishing rate with respect to hard materials to be polished having a Vickers hardness of at least 650 kg/mm$^2$, it is necessary to process a molded product obtained by molding a powder consisting mainly of a zirconia component which is abrasive grains, into a molded abrasive product having a bulk density of from 0.5 to 5.2 g/cm$^3$, a BET specific surface area of from 0.1 to 100 m$^2$/g and an average particle size of from 0.005 to 50 $\mu$m, and to use it for a polishing process, particularly for a CMP process. Further, they have found that polishing can be carried out efficiently by incorporating a polishing wheel comprising such a molded abrasive product with a polishing apparatus. The present invention has been accomplished on the basis of these discoveries.

DETAILED DESCRIPTION OF THE PREFERRED EMBODIMENTS

Characteristics of Molded Abrasive Product

The molded abrasive product of the present invention is made mainly of a zirconia component, and has a bulk density of from 0.5 to 5.2 g/cm$^3$, a BET specific surface area of from 0.1 to 100 m$^2$/g and an average particle size of from 0.005 to 50 $\mu$m.

Here, the molded abrasive product of the present invention is made mainly of a zirconia component, and has a zirconia component of preferably at least 90 wt % based on the total weight of the molded abrasive product. The zirconia component is not particularly limited so long as it is in the form of a powder and it can be processed into the molded abrasive product of the present invention. The zirconia component is meant for zirconium oxide or zirconium oxide containing a stabilizer.

As the stabilizer to be used for the zirconium oxide containing a stabilizer, is one having such a characteristic that it is solid-solved in zirconium oxide to maintain the tetragon system structure or the cubic system structure at a temperature in the vicinity of room temperature. It may, for example, be calcium oxide, magnesium oxide, yttrium oxide, indium oxide, scandium oxide, or a rare earth oxide such as cerium oxide, neodymium oxide, gadolinium oxide or ytterbium oxide. However, it is not particularly limited to such an oxide so long as it is a substance capable of stabilizing the zirconia. Further, one or more stabilizers may be used.

The amount of the stabilizer to be used is preferably within a range of the following formula (1) where A (mol) is the number of mols of zirconium oxide and B (mol) is the number of mols of the stabilizer, since stability of the zirconium oxide can further be improved:

$$0<B/(A+B)\leqq 0.2 \quad (1)$$

In the present specification, the amount of the zirconia component is calculated on the basis of the rest obtained by subtracting the water content from the total amount of the material powder for the molded abrasive product, containing a zirconia component as the main component, and as the impurity in the material powder, loss on ignition may, for example, be mentioned. Further, the above stabilizer is one which is solid-solved in the zirconium oxide to stabilize the zirconia, and the content is calculated as the zirconia component.

Further, an organic substance may be purposely introduced to e.g. pores in the molded abrasive product of the present invention, depending upon the purpose of the polishing. In such a case, one having the organic substance removed has to have a bulk density, a BET specific surface area and an average particle size within the above ranges.

Further, the crystal phase of the molded abrasive product of the present invention may be a single phase of any crystal structure of monoclinic system, tetragonal system or cubic system, or a mixed phase thereof, or may contain an amorphous phase.

It is important that the molded abrasive product of the present invention has an adequate strength and hardness in view of its application, and additionally, the strength and hardness of the individual particle constituting the product have to be considered, and it is essential for the product to contain a zirconia component as the main component. In the present invention, as an index of the hardness of the individual particle constituting of the molded abrasive product, a dense sintered product having a relative density of its component of at least 99% is prepared, and its Vikers hardness is measured. For example, a stabilized zirconia containing 3 mol % of yttria has a Vickers hardness of a level of 1,250 kg/mm$^2$ by measured in accordance with JIS-R-1610 at a test load of 10 kg for a load-holding time of 10 seconds. As a material having a higher Vickers hardness than this hardness, alumina (aluminum oxide) and silicon carbide may, for example, be mentioned. Although such materials may be applied to polishing of hard materials, they are poor in toughness as compared with a zirconia component, whereby they tend to be broken in the polishing as compared with the zirconia component.

As mentioned above, the molded abrasive product of the present invention contains a zirconia component in its composition. However, merely to contain a zirconia component is insufficient in view of polishing efficiency, durability of the molded product and the finish of the material to be polished, and in the present invention, the performances are attempted to improve by adjusting denseness and the pore structure of the molded abrasive product to be within a specific range.

Namely, the bulk density of the molded abrasive product of the present invention is preferably within a range of from 0.5 to 5.2 g/cm$^3$, more preferably from 0.8 to 4.5 g/cm$^3$, in order to hold the shape of the molded abrasive product during the polishing, and to efficiently obtain a smooth surface of the material to be polished. If the bulk density is less than 0.5 g/cm$^3$, the shape-holding property will be so poor that the shape can not be held, whereby the molded product itself is likely to wear out during the polishing. Further, if it exceeds 5.2 g/cm$^3$ on the contrary, the strength of the molded product itself tends to be too high, whereby the material to be polished may be broken during the polishing, or the surface of the molded abrasive product tends to be too smooth by the polishing, thus decreasing the polishing rate.

The BET specific surface area of the molded abrasive product of the present invention is preferably from 0.1 to 10 m$^2$/g, in order to hold the shape of the molded abrasive product during the polishing, and to obtain a smooth surface of the material to be polished. If the BET specific surface area exceeds 100 m$^2$/g the shape-holding property will be so poor that the shape of the molded abrasive product can not be held, whereby the molded product itself is likely to wear out during the polishing. Further, if it is less than 0.1 m$^2$/g, on the contrary, the strength of the molded product itself tends to be too high, whereby the material to be polished may be broken during the polishing, or the surface of the molded abrasive product may be too smooth by the polishing, thus decreasing the polishing rate.

The average particle size of the molded abrasive product is within a range of preferably from 0.005 to 50 $\mu$m, more preferably from 0.005 to 10 $\mu$m, so that the molding treatment for processing the material powder for the molded abrasive product into a porous product becomes easy, and a smooth surface of the material to be polished can be obtained by the polishing by using the obtained molded abrasive product. The reasons are such that although the smaller the average particle size of the molded abrasive product, the higher the surface precision of the material to be polished tends to be in many cases, a powder made of a zirconia component as a material and having a primary particle size of smaller than 0.005 $\mu$m is hardly available, and accordingly a molded abrasive product having an average particle size of smaller than 0.005 $\mu$m is hardly available practically, and further, if the average particle size is larger than 50 $\mu$m, the material to be polished may have defects. Here, the average particle size is meant for the particle size of zirconia component particles on the surface of the molded abrasive product, which can be measured by e.g. a scanning electron microscope (SEM) as shown in Examples.

Further, the pore size distribution of the molded abrasive product having such characteristics can be obtained by a method as shown in Examples, and is preferably as follows.

Firstly, the integrated volume of pores having pore sizes of from 0.01 to 1 $\mu$m is at least 20%, since the polishing rate will be high, and the polishing efficiency will be maintained for a longer time, when the pore size distribution is within this range.

Further, in such a molded abrasive product, the integrated volume of pores having pore sizes of from 1 to 360 $\mu$m is preferably from 10 to 70% of the integrated total pore volume of the molded abrasive product, since frequency of e.g. cloggings during the polishing can be more suppressed.

The compressive strength of such a molded abrasive product is at least 1 kg/cm$^2$ as a matter of course.

The above-mentioned molded abrasive product of the present invention may be directly used for polishing of hard materials to be polished. However, a material soluble in the polishing liquid (hereinafter referred to as soluble solid) may be filled in open pores present in the pores of the molded abrasive product, prior to the polishing.

The soluble solid is preferably an inorganic compound or an organic compound soluble in a polishing liquid to be used for practical polishing, which can be filled and solidified in the molded abrasive product, which gradually dissolves from the portion in contact with the polishing liquid in the polishing process, and which will not remain in the material to be polished as an impurity. Further, an aqueous polishing liquid is used in many cases practically, and it is thereby preferred to use a solid soluble in water, in order to avoid e.g. clogging.

As the specific example, the following may be mentioned.

An alkali such as an alkali metal hydroxide such as KOH, NaOH or LiOH, or an alkaline earth metal hydroxide such as $Mg(OH)_2$ or $Ca(OH)_2$, may, for example, be mentioned. Not only they will improve durability of the silica molded product to be a substrate, but also an effect of etching can be expected in a case of polishing a silicon wafer, for example, by elution of the alkali component during the polishing, whereby polishing may be carried out even with a polishing liquid containing no alkali content, such as distilled water.

Further, a salt of an alkali metal or an alkaline earth metal, such as LiF, NaCl or KCl, or a hydrate thereof, may, for example, be mentioned. Not only they will improve durability of the molded abrasive product of the substrate, but also metal ion dissolved from the soluble solid is expected to contribute to mechanochemical effect in the case where the material to be polished is e.g. a glass substrate, whereby polishing can be adequately carried out without using a loose abrasive grain as the polishing liquid.

A resin such as a thermosetting, anaerobic curing, ultraviolet-curing or thermoplastic epoxy type resin, an acryl type resin or a polyolefin type resin, or an adhesive such as an instant curing, contact-curing, ultraviolet-curing or anaerobic curing instant adhesive, an elastic abrasive, a hot melt type adhesive, an elastomer type adhesive, an emulsion type adhesive, a thermosetting resin type adhesive or a thermoplastic resin type adhesive, may, for example, be mentioned. They will improve durability of the molded product to be a substrate.

A wax such as a water-soluble wax may, for example, be mentioned, which will improve durability of the molded product to be a substrate.

An organic substance such as an amine such as urea, or an organic acid such as oxalic acid, malonic acid, malic acid, citric acid, lactic acid or tartaric acid, may, for example, be mentioned. They will not only improve durability of the molded abrasive product of the substrate, but also improve the rate or abrasion.

The above inorganic compounds and organic compounds soluble in the polishing liquid may be used alone or in combination of at least two.

The amount of the soluble solid to be filled in the molded abrasive product is preferably at least 10 vol % to the total volume of the open pores in the molded abrasive product. If the amount of the soluble solid filled is less than 10 vol %, effects of suppressing abrasion and improving durability of the molded product may be small during the polishing in some cases.

Method for Producing Molded Abrasive Product

The method for producing the molded abrasive product of the present invention is not particularly limited so long as it is a method capable of producing a molded abrasive product having the above characteristics. A method of molding a powder made of a zirconia component, or a method of carrying out processing such as calcination after molding, may, for example, be mentioned.

More specifically, in the method for producing the molded abrasive product of the present invention, pressure is applied to the material powder to mold it into a molded product having an appropriate shape and size, followed by processing as the case requires, to obtain a molded product to be used for polishing.

Here, in the case of molding by applying pressure, a molding method such as press molding may, for example, be mentioned. Its pressure condition is not particularly limited, and the method may be carried out under known conditions. Further, e.g. cast molding, injection molding or extrusion molding may be applicable.

Further, a treatment may be applied to the material powder at the time of molding, in order to improve molding property of the material powder. As the specific treatment, a method of compaction may, for example, be mentioned, and its condition is not particularly limited. Further, the material powder may be granulated by e.g. spray dry method or rolling method, or e.g. a binder or a wax may be added to the powder, in order to improve modeling property of the material powder.

Further, it is preferred to degrease the material powder when it is processed into the molded abrasive product, in the case where an organic substance such as a wax or a binder is added to the material powder before molding, in order to improve molding property of the material powder into the molded product made of a zirconia component. The method of degreasing is not particularly limited, and degreasing by heating in the air or degreasing by heating in an inert atmosphere of e.g. nitrogen, argon or helium, may, for example, be mentioned. The pressure of the atmosphere gas may be elevated pressure or normal pressure, or reduced pressure as the case requires. Further, also in order to improve molding property, water may be added to the material powder, and the material powder may be dried before the later calcination operation.

Then, it is preferred to carry out a processing such as calcination by heating, on the obtained molded product, in order to increase the strength and to improve durability of the molded product to be used for polishing, since the molded product, particularly a molded product having the binder removed therefrom, is usually fragile. However, the method to improve durability is not particularly limited to calcination by heating, and for example, a method of introducing a substance into the pores of the molded product may also be employed.

In the case of calcination by heating, the calcination conditions are not particularly limited, and e.g. the calcination temperature, the calcination time, the calcination program and the calcination atmosphere may be optionally selected.

As mentioned above, as the method of processing the molded product made of a zirconia component into the molded abrasive product, degreasing by heating, calcination by heating, machine processing, chemical treatment or physical treatment, or a combination thereof, may, for example, be mentioned. However, the method is not particularly limited so long as it can impart strength adequate for polishing as the molded abrasive product.

Constitution of Polishing Wheel

Now, the method of fitting the molded abrasive product to a support, to obtain a polishing wheel, and polishing by using it, will be explained below.

The molded abrasive product is fitted to a support to form a polishing wheel.

Here, the support is a structure constituting the polishing wheel, which may be made of various materials and may have various shapes. The molded abrasive product is disposed and fixed on the support by the following means, to form the polishing wheel. The method of fixation is not particularly limited so long as the object of the present invention can be achieved, and a method of bonding them to each other for fixation by means of an adhesive, or a method of forming irregularities on the support and fitting the molded abrasive product thereto, may, for example, be mentioned.

The number of the molded abrasive product to be fixed to the support for polishing is one or more, and preferably at least two. The reasons are: 1) to appropriately discharge the polishing liquid used in the polishing process during polishing so as to improve the polishing rate. When the polishing wheel is formed by using at least two molded abrasive products, the polishing liquid can be discharged from the space between the molded abrasive products. Further, in a case of using one molded abrasive product, it is preferred to make an appropriate groove structure on the molded product at its surface for polishing so as to discharge the polishing liquid; 2) in the case where the polishing wheel is formed by using at least two molded abrasive products, the polishing wheel will fit to the material to be polished well, and the entire surface of the material to be polished will be efficiently polished without unequality of the polishing rate.

The shape of the molded abrasive product to be used is not particularly limited, and the molded abrasive product may have any shape so long as it is fitted to the support for polishing. A columnar pellet, a prism pellet such as a square pole pellet or a triangle pole pellet, or a fan-shaped pellet, or a ring-shaped pellet having the center portion thereof bored, may, for example, be mentioned, and further, any shape obtained by combination of lines and curves of the surface which will be in contact with the material to be polished, may be mentioned. Further, the size is not particularly limited so long as it is within a range with which the molded abrasive product is usually used, and it is determined depending upon the size of the support with which the molded abrasive product is incorporated for the polishing wheel.

The mode of disposing the molded abrasive product to the support to obtain the polishing wheel is not particularly limited so long as the molded abrasive products having the above characteristics are combined. For example, small pieces of the molded abrasive products are combined and integrated, or the molded abrasive product is embedded in a large disk.

In the case of disposing at least two molded abrasive products on the support, it is preferred to arrange the surfaces for polishing of the molded abrasive products to fit the shape of the material to be polished. In such a case, a support having a shape fitted thereto may be selected. For example, in the case where the surface of the material to be polished is flat, it is preferred to make the surface of the molded abrasive product, which will be in contact with the material to be polished, to be flat, and in the case where the surface of the material to be polished is curved, it is preferred to make the surface to be curved correspondingly thereto. This is to make the surface of the molded abrasive product, which will be in contact with the material to be polished, to be large, since they will be directly in contact with each other when polishing by using the obtained polishing wheel is carried out. Particularly in the case where the surface is made to be flat, it is preferred to dispose the molded abrasive products so as to minimize dispersion of the height in direction perpendicular to the polishing wheel.

Polishing Method by using the Polishing Wheel

The molded abrasive product is fitted to the support to obtain the polishing wheel as mentioned above. The method of polishing by using the polishing wheel of the present invention is not particularly limited with respect to e.g. the shape of the wheel, the polishing conditions, and the presence or absence of the polishing liquid, so long as the wheel is used in the polishing process. For example, in the case of using a polishing liquid, a conventional polishing liquid such as water, an aqueous potassium hydroxide solution, an aqueous sodium hydroxide solution, or an aqueous solution containing an amine or an organic acid, may be employed. Further, the temperature of such a polishing liquid is not particularly limited so long as it is lower than its boiling point, and the flow rate of the polishing liquid is not particularly limited either. Further, polishing conditions such as the polishing pressure and the relative speed between the material to be polished and the wheel (rotation rate of the polishing wheel) during polishing are not particularly limited.

Here, the polishing wheel is used for polishing by directly contacting the material to be polished with the molded abrasive product, and it has to have a sufficient strength for the polishing process and performances to polish the material to be polished. Accordingly, as its shape, not only the wheel may have the same shape as the material to be polished, but also it may have a nonplanar shape as the case requires. The shape may, for example, be a plate, a disk, a ring or a cylinder.

Further, in the conventional method, the polishing operation is frequently interrupted since the performance of the polishing cloth is likely to deteriorate and it has to be renewed frequently, whereas in the present invention, since no polishing cloth is used, and durability is improved as the molded abrasive product of the present invention is used, frequency of the renewal can be reduced, whereby the polishing operation can be carried out efficiently.

Further, with respect to the waste polishing liquid containing loose abrasive grains which is a problem in a method using a conventional abrasive, when the molded abrasive product of the present invention is used, the polishing is carried out by using no loose abrasive grains or by using only a small amount, whereby the amount of the loose abrasive grains and grains in the waste polishing liquid generated by the polishing will be reduced, and the problem of the waste liquid treatment will be reduced. For example, it is confirmed that the amount of the grains which are no more useful, contained in the waste polishing liquid, is reduced, by the fact that when the waste polishing liquid is irradiated with light, the transmittance is high as compared with the conventional method. From the viewpoint of such a problem of the waste polishing liquid, the transmittance at 600 nm through the waste polishing liquid is preferably at least 10% of the transmittance through water, and it is preferred to use a polishing liquid of which the waste liquid has such a transmittance. In the case of using the molded abrasive product of the present invention, the polishing liquid is not always used, and no waste liquid will be generated in the case of using no polishing liquid. Here, the loose abrasive grains to be used are not particularly limited, and e.g. the material and particle size may be optionally selected depending upon the purpose.

The molded abrasive product of the present invention and the polishing wheel employing it, are useful for polishing substrate materials such as semiconductor substrates, oxide substrates and glass substrates, optical materials such as magnetic head materials, glass, metal materials and lenses, and stones for e.g. architecture, and also for a CMP process. They are preferably used for polishing substrate materials and for a CMP process, and particularly useful to make e.g. semiconductor structures to be flat, since the material can be effectively polished as sagging is small as compared with the conventional method of using a polishing cloth.

Now, the present invention will be explained in further detail with reference to Examples. However, it should be understood that the present invention is by no means restricted thereto. Evaluations were carried out based on the following methods.

Measurement of Content of Constituent

As the constituents of the material powder for the molded abrasive product or of the molded abrasive product, a zirconia component (including a stabilizer component), the moisture content and the loss on ignition (hereinafter referred to as Ig loss) were measured by the following methods.

The total zirconia component was measured by ICP method and calculated as the amount of the oxides.

The moisture content was calculated from the weight change as measured before and after heat treatment of the material powder at 110° C. for 2 hours.

The Ig loss was obtained by heating the material powder at 110° C. for 2 hours to remove moisture, further heating the moisture-removed material powder at 1,100° C., and calculating the weight change before and after the heat treatment at 1,100° C.

Bulk Density of the Molded Abrasive Product

A plate-like sample of 100 mm×100 mm×15 mm (thickness) was prepared. The bulk density was calculated from the weight of said sample measured by an electron balance, and its geometry measured by a micrometer.

BET Specific Surface Area of Molded Abrasive Product

The molded abrasive product was pulverized, and the BET specific surface area was measured by a BET single-point method using MONOSORB (manufactured by QUANTACHROME Co., US).

Average Particle Size of Molded Abrasive Product

A part of the molded abrasive product was observed by a scanning electron microscope ISI DS-130 manufactured by Akashi Seisakusho K.K., and the average particle size was obtained by interceptive method considering the portion of particles made of a zirconia component alone.

Pore Size Distribution

With respect to a pore size distribution, measurement was carried out by a method of mercury penetration within a pressure range of from 0 to 270 MPa using a mercury porosimeter (Poresizer 9320, manufactured by SHIMADZU Corp.).

Compressive Strength

A sample having a size of 10 mm×10 mm×7 mm (thickness) was prep a red, a nd the compressive strength was measured in accordance with JIS R-1608 by using SHIMADZU Autograph IS-10T (manufactured by Shimadzu Corp.) while applying a load at a crosshead speed of 0.5 mm/min.

Vickers Hardness of Material to be Polished

The Vickers hardness was measured in accordance with JIS R-1610 by using a micro hardness meter MVK-E (manufactured by Akashi Seisakusho K.K.) at room temperature, while pressing an indentater to the surface of the mirror-finished material to be polished at a test load of 100 g for a load-holding time of 10 seconds.

Polishing Test

In each Example, molded abrasive products (in the form of a column having a diameter of 25 mm and a thickness of 5 mm) having characteristics as shown in Table 1 were prepared, and 100 of these molded abrasive products were fitted to a platen (diameter: 300 mm) to form a polishing wheel for a polishing apparatus PLANOPOL/PEDEMAX2 (manufactured by Struers), and the surfaces of the molded products were arranged to be flat. Then, the material to be polished (square of 45 mm×45 mm), centerline average roughness (Ra) of abut 200 nm as shown in Table 2, 3 or 4, was polished for 20 minutes by using the wheel having the molded products fitted thereto at a rotation of the wheel of 300 rpm under a predetermined polishing pressure of the wheel on the material to be polished, i.e. under 200 g/cm$^2$ on glass or lithium tantalate ($LiTaO_3$) or under 100 g/cm$^2$ on quartz glass, while dropping a predetermined polishing liquid thereto at a rate of 200 ml/min. The surface of the material after polishing was observed by a microscope (model: BH-2, manufactured by OLYMPUS OPTICAL CO., LTD.). As the evaluation, the case where the surface was extremely smooth and had no scratch or the like thereon, is expressed by ○, and the case where the surface was not smooth and the polishing could not be applied thereto, by X.

Surface Precision

The surface roughness of the material to be polished after polishing was measured by a method of measuring repulsion force in the contact mode by using an atomic force microscope (AFM)SPI3600 (manufactured by SII Co.). The surface precision was expressed as the centerline average roughness (Ra) obtained from the average of values obtained by measuring three optional regions of the material to be polished, each having a size of 5 μm×5 μm.

Polishing Rate

The polishing rate was obtained by measuring the thickness of the material to be polished by a dial gauge. It was obtained by measuring the thickness of the material to be polished at optional 10 points on the surface to be polished before and after polishing, to obtain rates of abrasion per minute, and the average was taken as the polishing rate (μm/min).

Transmittance of Light through the Waste Polishing Liquid

The turbidity of the waste polishing liquid resulting from the polishing test was evaluated by measuring the transmittance of light with a wavelength of 600 nm by a spectrophotometer (model: Ubest-55, manufactured by Nippon Bunko) using purified water as the standard. With respect to the measurement results, a high transmittance indicates that the amount of a loose abrasive grain in the waste polishing liquid is small, and a low transmittance indicates that the amount is large.

Production and Evaluation of Molded Abrasive Product

Each of molded abrasive products 1 to 11 was prepared by using, as a material, a powder having characteristics as shown in Table 1, adding one of a polyvinyl alcohol powder, potatostarch, a metacrylic acid powder and a paraffin wax powder thereto followed by mixing except for the molded abrasive products 1 and 10, molding the powder or the powder mixture under a pressure of from 50 to 3,000 kg/cm$^2$ to obtain a molded product, and firing it at a temperature of from 700 to 1,500° C. to obtain a molded abrasive product. The obtained molded abrasive product was evaluated by the above methods, and in Table 1 are shown the bulk density, the BET specific surface area, the average particle size and the compressive strength of the molded abrasive product, and the percentages of the integrated volumes of pores having pore sizes of from 0.01 to 1 μm, and from 1 to 360 μm as the pore size distribution.

TABLE 1

| Molded abrasive product No. | 1 | 2 | 3 | 4 | 5 | 6 | 7 | 8 | 9 | 10 | 11 |
|---|---|---|---|---|---|---|---|---|---|---|---|
| Material powder Zirconia component composition | | | | | | | | | | | |
| Zirconium oxide (wt %) | 94.8 | 94.8 | 94.8 | 94.8 | 94.8 | 96.6 | 83.7 | 99.6 | 94.8 | 94.8 | — |
| Stabilizer | $Y_2O_3$ | $Y_2O_3$ | $Y_2O_3$ | $Y_2O_3$ | $Y_2O_3$ | MgO | $CeO_2$ | — | $Y_2O_3$ | $Y_2O_3$ | — |
| Stabilizer content (wt %) | 5.1 | 5.1 | 5.1 | 5.1 | 5.1 | 3.1 | 16.1 | — | 5.1 | 5.1 | — |
| Silica component composition (wt %) | — | — | — | — | — | — | — | — | — | — | 91.1 |
| Impurities | | | | | | | | | | | |
| Moisture content (wt %) | 0.2 | 0.2 | 0.2 | 0.2 | 0.2 | 0.2 | 0.2 | 0.2 | 0.2 | 0.2 | 5 |
| Ig loss (wt %) | 0.2 | 0.2 | 0.2 | 0.2 | 0.2 | 0.2 | 0.2 | 0.2 | 0.2 | 0.2 | 3.9 |
| Molded abrasive product | | | | | | | | | | | |
| Bulk density (g/cm$^3$) | 3.9 | 4.1 | 2.3 | 3.5 | 1.3 | 2.2 | 3.1 | 1.9 | 0.2 | 5.9 | 0.6 |
| BET specific surface area (m$^2$/g) | 3.3 | 2.1 | 3.0 | 2.3 | 22 | 14 | 8 | 13 | 23 | 0.2 | 25 |

TABLE 1-continued

| Molded abrasive product No. | 1 | 2 | 3 | 4 | 5 | 6 | 7 | 8 | 9 | 10 | 11 |
|---|---|---|---|---|---|---|---|---|---|---|---|
| Average particle size (μm) | 0.35 | 0.52 | 0.33 | 0.54 | 0.04 | 0.07 | 0.12 | 0.08 | 0.04 | 4.8 | 0.11 |
| Pore size: 0.01–1 μm (%) | 92 | 48 | 72 | 36 | 69 | 58 | 66 | 70 | 72 | 5 | 88 |
| Pore size: 1–360 μm (%) | 6 | 39 | 27 | 22 | 28 | 40 | 31 | 28 | 26 | 92 | 11 |
| Compressive strength ($kg/cm^2$) | ≧500 | ≧500 | 480 | 260 | 150 | 82 | 93 | 79 | ≦0.5 | ≧500 | 42 |

Polishing by Molded Abrasive Product and Evaluation Thereof

A. Polishing by using Distilled Water

EXAMPLES 1 to 5 AND COMPARATIVE EXAMPLES 1 to 3

A material to be polished (composition: glass, quartz glass or lithium tantalate ($LiTaO_3$)) as shown in Table 2, having a shape of a square of 45 mm×45 mm, was polished by a molded abrasive product as shown in Table 2 in accordance with the above polishing test using distilled water as the polishing liquid. In Table 2 are shown the smoothness (condition of the surface after polishing), the polishing rate and the centerline average roughness (Ra) as the surface precision of the material to be polished subjected to the polishing test, together with the transmittance of light through the waste polishing liquid after the polishing test.

TABLE 2

| | Ex. 1 | Ex. 2 | Ex. 3 | Ex. 4 | Ex. 5 | Comp. Ex. 1 | Comp. Ex. 2 | Comp. Ex. 3 | Comp. Ex. 4 |
|---|---|---|---|---|---|---|---|---|---|
| Molded abrasive product No. | 1 | 2 | 3 | 3 | 3 | 9 | 10 | 11 | — |
| Material to be polished | | | | | | | | | |
| Material | Glass | Glass | Glass | $LiTaO_3$ | Quartz | Glass | Glass | Glass | Glass |
| Vickers hardness ($kg/mm^2$) | 720 | 720 | 720 | 880 | 870 | 720 | 720 | 720 | 720 |
| Polishing liquid | Distilled water | Distilled water | Distilled water | Distilled water | Distilled water | Distilled water | Distilled water | Distilled water | Distilled water |
| Evaluation | | | | | | | | | |
| Smoothness | ○ | ○ | ○ | ○ | ○ | — | x | ○ | — |
| Polishing rate (μm/min) | 0.09 | 0.15 | 0.24 | 0.13 | 0.20 | — | — | ≦0.01 | — |
| Centerline average roughness (nm) | 2.35 | 2.43 | 2.18 | — | 0.21 | — | — | 2.28 | — |
| Transmittance through waste polishing liquid (%) | 88 | 84 | 84 | 85 | 86 | — | — | 89 | — |

As evident from Table 2, in Examples 1 to 5, the material to be polished could be quickly polished by using distilled water as a polishing liquid. On the contrary, in Comparative Example 1, the molded abrasive product was broken and polishing could not be carried out. In Comparative Example 2, the surface of the material to be polished after polishing was poor in smoothness. In Comparative Example 3 wherein the molded abrasive product made mainly of silica was used, the polishing rate was low.

COMPARATIVE EXAMPLE 4

A commercially available polishing pad made of an expanded urethane was mounted on a support (diameter: 300 mm) to form a polishing wheel of a polishing apparatus PLANOPOL/PEDEMAX2 (manufactured by Struers), and a glass (square of 45 mm×45 mm) as the material to be polished was polished at a rotation of the wheel of 300 rpm under a predetermined polishing pressure, while dropping distilled water as a polishing liquid thereto at a rate of 200 ml/min. However, the polishing rate was so low that it could not be measured.

B. Polishing by using a Polishing Liquid Containing Zirconia Abrasive Grains as the Loose Abrasive Grains EXAMPLES 6 to 15 AND COMPARATIVE EXAMPLES 5 to 7

A material to be polished (composition: glass, quartz glass or lithium tantalate ($LiTaO_3$)) as shown in Table 3, having a shape of a square of 45 mm×45 mm, was polished by a molded abrasive product as shown in Table 3 in accordance with the above polishing test by using, as a polishing liquid, one obtained by diluting commercially available zirconia abrasive grains having an average particle size of 0.2 μm with distilled water to have a concentration as shown in Table 3 (expressed as polishing liquid A in Table 3). In Table 3 are shown the smoothness (condition of the surface after polishing), the polishing rate and the centerline average roughness (Ra) as the surface precision of the material to be polished subjected to the polishing test, together with the transmittance of light through the waste polishing liquid after the polishing test.

TABLE 3

| | Ex. 6 | Ex. 7 | Ex. 8 | Ex. 9 | Ex. 10 | Ex. 11 | Ex. 12 | Ex. 13 | Ex. 14 | Ex. 15 |
|---|---|---|---|---|---|---|---|---|---|---|
| Molded abrasive product No. | 1 | 1 | 2 | 6 | 7 | 8 | 1 | 3 | 1 | 3 |
| Material to be polished | | | | | | | | | | |
| Material | Glass | Glass | Glass | Glass | Glass | Glass | $LiTaO_3$ | $LiTaO_3$ | Quartz | Quartz |
| Vickers hardness ($kg/mm^2$) | 720 | 720 | 720 | 720 | 720 | 720 | 880 | 880 | 870 | 870 |
| Polishing liquid A | | | | | | | | | | |
| Abrasive grain concentration (wt %) | 5 | 10 | 5 | 5 | 5 | 5 | 5 | 5 | 5 | 5 |
| Evaluation | | | | | | | | | | |
| Smoothness | ○ | ○ | ○ | ○ | ○ | ○ | ○ | ○ | ○ | ○ |
| Polishing rate ($\mu$m/min) | 0.72 | 0.76 | 0.88 | 0.94 | 1.02 | 0.68 | 0.42 | 0.48 | 0.64 | 0.68 |
| Centerline average roughness (nm) | 2.85 | 2.67 | 2.05 | 2.01 | 2.48 | 2.25 | — | — | 0.26 | 0.25 |
| Transmittance through waste polishing liquid (%) | 22 | 12 | 17 | 13 | 16 | 12 | 22 | 16 | 24 | 17 |

| | Comp. Ex. 5 | Comp. Ex. 6 | Comp. Ex. 7 | Comp. Ex. 8 |
|---|---|---|---|---|
| Molded abrasive product No. | 11 | 11 | 11 | — |
| Material to be polished | | | | |
| Material | Glass | $LiTaO_3$ | Quartz | Glass |
| Vickers hardness ($kg/mm^2$) | 720 | 880 | 870 | 720 |
| Polishing liquid A | | | | |
| Abrasive grain concentration (wt %) | 5 | 5 | 5 | 20 |
| Evaluation | | | | |
| Smoothness | ○ | ○ | ○ | ○ |
| Polishing rate ($\mu$m/min) | 0.52 | 0.22 | 0.55 | 0.53 |
| Centerline average roughness (nm) | 2.12 | — | 0.31 | 4.25 |
| Transmittance through waste polishing liquid (%) | 18 | 19 | 17 | 1 |

COMPARATIVE EXAMPLE 8

A glass having a shape of a square of 45 mm×45 mm as the material to be polished, was polished in the same manner as in Comparative Example 3 by using, as the polishing liquid, one obtained by diluting commercially available zirconia abrasive grains having an average particle size of 0.2 $\mu$m with distilled water to have an abrasive grain concentration of 20 wt % at which the conventional polishing had been carried out. In Table 3 are shown the smoothness (the condition of the surface after polishing), the polishing rate and the centerline average roughness (Ra) as the surface precision of the material to be polished subjected to the polishing test, together with the transmittance of light through the waste polishing liquid after the polishing test.

In Examples 6 to 15, the material to be polished could be quickly polished by the molded abrasive product made mainly of a zirconia component. On the contrary, in Comparative Examples 5 to 7 wherein the molded abrasive product made mainly of silica was used, the polishing rate of each of the materials to be polished having different Vickers hardnesses was low as compared with Examples.

Further, in Comparative Example 8, although the material to be polished could be polished by using a polishing pad as a polishing cloth and loose abrasive grains, the transmittance of light through the waste polishing liquid was low, thus indicating that the amount of the loose abrasive grains in the waste liquid was large.

C. Polishing by using a Polishing Liquid Containing Ceria Abrasive Grains as the Loose Abrasive Grains

EXAMPLES 16 AND 17 and COMPARATIVE EXAMPLES 9 AND 10

A material to be polished (composition: glass, quartz glass or lithium tantalate ($LiTaO_3$)) as shown in Table 4, having a shape of a square of 45 mm×45 mm, was polished by a molded abrasive product as shown in Table 4 in accordance with the above polishing test by using, as the polishing liquid, one obtained by diluting commercially available ceria abrasive grains having an average particle size of 0.5 $\mu$m with distilled water to have a concentration as shown in Table 4 (expressed as polishing liquid B in Table 4). In Table 4 are shown the smoothness (the condition of the surface after the polishing), the polishing rate and the centerline average roughness (Ra) as the surface precision of the material to be polished subjected to the polishing test, together with the transmittance of light through the waste polishing liquid after the polishing test.

TABLE 4

| | Ex. 16 | Ex. 17 | Comp. Ex. 9 | Comp. Ex. 10 |
|---|---|---|---|---|
| Molded abrasive product No. | 4 | 1 | 11 | 11 |
| Material to be polished | | | | |
| Material | Glass | Quartz | Glass | Quartz |
| Vickers hardness ($kg/mm^2$) | 800 | 870 | 800 | 870 |

TABLE 4-continued

| | Ex. 16 | Ex. 17 | Comp. Ex. 9 | Comp. Ex. 10 |
|---|---|---|---|---|
| Polishing liquid B | | | | |
| Abrasive grain concentration (wt %) | 5 | 5 | 5 | 5 |
| Evaluation | | | | |
| Smoothness | ○ | ○ | ○ | ○ |
| Polishing rate (μm/min) | 0.41 | 0.46 | 0.20 | 0.25 |
| Centerline average roughness (nm) | 2.88 | 0.34 | 2.84 | 0.28 |
| Transmittance through waste polishing liquid (%) | 14 | 22 | 18 | 19 |

In Examples 16 and 17 wherein the molded abrasive product made mainly of a zirconia component was used, the material to be polished could be quickly polished. On the contrary, in Comparative Examples 9 and 10 wherein the molded abrasive product made mainly of silica was used, the polishing rate of each of the materials to be polished having different Vickers hardnesses, was low as compared with Examples.

According to the present invention, e.g. substrate materials and optical materials can be polished with a surface precision equal to or higher than that achieved by a conventional method, with generating substantially no waste polishing liquid containing a large amount of loose abrasive grains during the polishing process, and the molded abrasive product has a durability in the polishing treatment, whereby it is useful for the polishing process. Further, materials to be polished having a high hardness can be quickly polished with acceptable finish.

What is claimed is:

1. A molded abrasive product which is made mainly of a zirconia component and which has a bulk density of from 0.5 to 5.2 g/cm$^3$, a BET specific surface area of from 0.1 to 100 m$^2$/g and an average particle size of from 0.005 to 50 μm.

2. The molded abrasive product according to claim 1, which has a pore size distribution such that the integrated volume of pores having pore sizes of from 0.01 to 1 μm is at least 20% of the integrated total pore volume of the molded abrasive product.

3. The molded abrasive product according to claim 2, which has a pore size distribution such that the integrated volume of pores having pore sizes of from 1 to 360 μm is from 10 to 70% of the integrated total pore volume of the molded abrasive product.

4. A polishing wheel comprising a support and at least one molded abrasive product as defined in claim 1 fixed to the support.

* * * * *